US008863315B1

(12) United States Patent
Sanders

(10) Patent No.: US 8,863,315 B1
(45) Date of Patent: Oct. 21, 2014

(54) DECORATIVE COLLAR STAY SYSTEM

(76) Inventor: Horace Sanders, Zebulon, NC (US)

( * ) Notice: Subject to any disclaimer, the term of this patent is extended or adjusted under 35 U.S.C. 154(b) by 130 days.

(21) Appl. No.: 13/602,586

(22) Filed: Sep. 4, 2012

Related U.S. Application Data

(60) Provisional application No. 61/545,831, filed on Oct. 11, 2011.

(51) Int. Cl.
*A41D 25/04* (2006.01)
*A41B 3/12* (2006.01)

(52) U.S. Cl.
USPC ..... 2/145; 2/137; 24/116 A; 24/900.1; 24/66.2; 24/66.4

(58) Field of Classification Search
USPC ..... 2/144, 145, 148, 149, 150, 155, 156, 2/130, 137; 24/116 R, 116 A, 114.11, 24/49.1, 50, 51, 54, 58, 900.1, 40, 62, 24/66.4, 66.3, 66.6, 66.7, 66.8, 66.13, 326, 24/327, 329, 331, 335, 336, 346, 349; 63/1.18, 1.11, 3.1, 4, 21, 24
See application file for complete search history.

(56) References Cited

U.S. PATENT DOCUMENTS

| | | | | | |
|---|---|---|---|---|---|
| 1,633,966 | A | * | 6/1927 | Wolf | 24/710.7 |
| 1,683,545 | A | * | 9/1928 | Harris | 63/1.15 |
| 1,849,321 | A | * | 3/1932 | Tomlinson | 24/299 |
| 1,862,444 | A | * | 6/1932 | Vickers | 24/299 |
| 1,896,029 | A | * | 1/1933 | Gunther | 24/299 |
| 1,996,025 | A | | 3/1935 | Mix | |
| 2,022,346 | A | | 11/1935 | Hickok et al. | |
| 2,028,705 | A | * | 1/1936 | Johnson | 24/568 |
| 2,232,703 | A | | 2/1941 | Hotson | |
| D306,146 | S | | 2/1990 | Graham | |
| D334,906 | S | | 4/1993 | Sprick | |
| 5,253,633 | A | * | 10/1993 | Sisko | 124/44.5 |
| 6,070,434 | A | * | 6/2000 | Traver | 63/1.11 |
| 6,247,207 | B1 | | 6/2001 | Nitsche | |

* cited by examiner

*Primary Examiner* — Gloria Hale
(74) *Attorney, Agent, or Firm* — RG Patent Consulting, LLC; Rachel Gilboy

(57) ABSTRACT

An apparatus for holding a shirt collar in stasis while being worn by a user to provide a desired formal look. The decorative collar stay system includes a collar link to bridge the gap between the right side and the left side of a shirt collar and can be adorned with decorative items as determined by the user to affect the desired look. Clips on each end of the collar link may have alligator-type clips that secure to the right side and left side of a shirt collar.

20 Claims, 5 Drawing Sheets

DECORATIVE COLLAR STAY SYSTEM

CROSS-REFERENCE TO RELATED APPLICATION

The present applications are related to and claims priority from prior provisional application Ser. No. 61/545,831 filed Oct. 11, 2011 which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of neckwear appliances and more specifically relates to a decorative stay for attachment to shirt collars.

DESCRIPTION OF THE RELATED ART

Most individuals in modern society wear garments on a regular basis. Garments often comprise shirts such as dress shirts that may be worn for formal events. In clothing, a collar is the part of a (dress or other) shirt, dress, coat or blouse that fastens around or frames the neck. Among clothing construction professionals, a collar is differentiated from other neklines such as revers and lapels, by being made from a separate piece of fabric, rather than a folded or cut part of the same piece of fabric used for the main body of the garment.

Collared shirts have remained as a staple garment for men and women over the years; however frequently wearers may want to ornament their collars in a manner to make a fashion statement. Additionally, sometimes a shirt collar may need extra support to stand up in the manner the shirt design may have originally intended. Over time, a collar may lay flat on the chest, roll under itself, turn upwards unevenly and turn sideways. This positioning tends to detract from the appearance and may ruin the collar over an extended duration. Such a collar condition does not look proper when worn with formal attire.

Various attempts have been made to solve the above-mentioned problems such as those found in U.S. Pat. No. 6,247,207 to Nitsche; U.S. Pat. No. 2,022,346 to Hickok et al; U.S. Pat. No. D306,146 to Graham; U.S. Pat. No. 2,232,703 to Hotson; U.S. Pat. No. D334,906 to Sprick; and U.S. Pat. No. 1,996,025 to Mix. This prior art is representative of collar stays. None of the above inventions and patents, taken either singly or in combination, is seen to describe the invention as claimed.

Ideally, a decorative collar stay system should provide a user-friendly device to hold shirt collars in place, and yet, would operate reliably and be manufactured at a modest expense. Thus, a need exists for a reliable decorative collar stay system to decoratively hold shirt collars in place and to avoid the above-mentioned problems.

BRIEF SUMMARY OF THE INVENTION

In view of the foregoing disadvantages inherent in the known neckwear appliances art, the present invention provides a novel decorative collar stay system. The general purpose of the present invention, which will be described subsequently in greater detail, is to provide a collar stay to hold shirt collars in a vertical position.

A decorative collar stay system is disclosed herein, in a preferred embodiment, comprising a collar-stay-assembly comprising a collar-link having a first end and a second end. The collar-link is used (length adjustable via bending on certain embodiments) to bridge a gap between the right side and the left side of a shirt-collar (the left and right sides comprising opposing ends of a one-piece collar around the neck of the user) to help the shirt-collar stand up vertically. The collar-link is able to be adjustably-curved as desired by a user in certain embodiments. The collar-link may comprise a cylindrical rod which comprises an outer circumference. A plurality of decorative items may be collectably-strung thereon. The decorative items may comprise through-holes to allow for 'stringing'.

The collar-stay-assembly further comprises exactly two attachment-clips in preferred embodiments including a right-side-attachment-clip and a left-side-attachment-clip. The right-side-attachment-clip is attached to the first end of the collar-link. The right-side-attachment-clip is able to be biasingly-fastened and biasingly-unfastened to and from the right side of a shirt collar (via squeezing motion). The right-side-attachment-clip preferably comprises an alligator-type clip and may be adorned with decorative items. The right-side-attachment-clip further comprises a plurality of first jaw-teeth located inside the right-side-attachment-clip to grippably secure a shirt collar therein.

The collar-stay-assembly also comprises a left-side-attachment-clip attached to the second end of the collar-link. The left-side-attachment-clip is able to be biasingly-fastened and biasingly-unfastened to and from the left side of a shirt collar, in a similar manner to the right side version. The left-side-attachment-clip also preferably comprises an alligator-type clip which may be adorned with decorative items. The left-side-attachment-clip further comprises a plurality of second jaw-teeth located inside the left-side-attachment-clip to grippably secure a shirt collar therein. The decorative collar stay assembly comprises in combination the collar-link and the attachment-clips; wherein the right side and left side of the shirt collar are held in stasis via the collar-stay-assembly while being worn by a user to provide a desired formal look. Certain embodiments may comprise names, logos or other such indicia.

A kit for manufacture and/or sale and method of use is also described herein.

The present invention holds significant improvements and serves as a decorative collar stay system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, decorative collar stay system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a collar accessory and more particularly to a decorative collar stay system as used to improve the appearance and function of shirts with collars and have those collars remain in a preferred positioning over a duration.

Generally speaking, the decorative collar stay system provides an apparatus and system for helping users wear their collared shirts in a vertical and formal manner. The decorative collar stay system provides an attractive shirt collar attachment bar that allows a user to easily connect the right side of a shirt collar to the left side of a shirt collar. An object of the decorative collar stay system is to use decorations such as jewelry, stones, and the like, to customize their attire in a way that shows their individuality and creativity.

Figure 1:
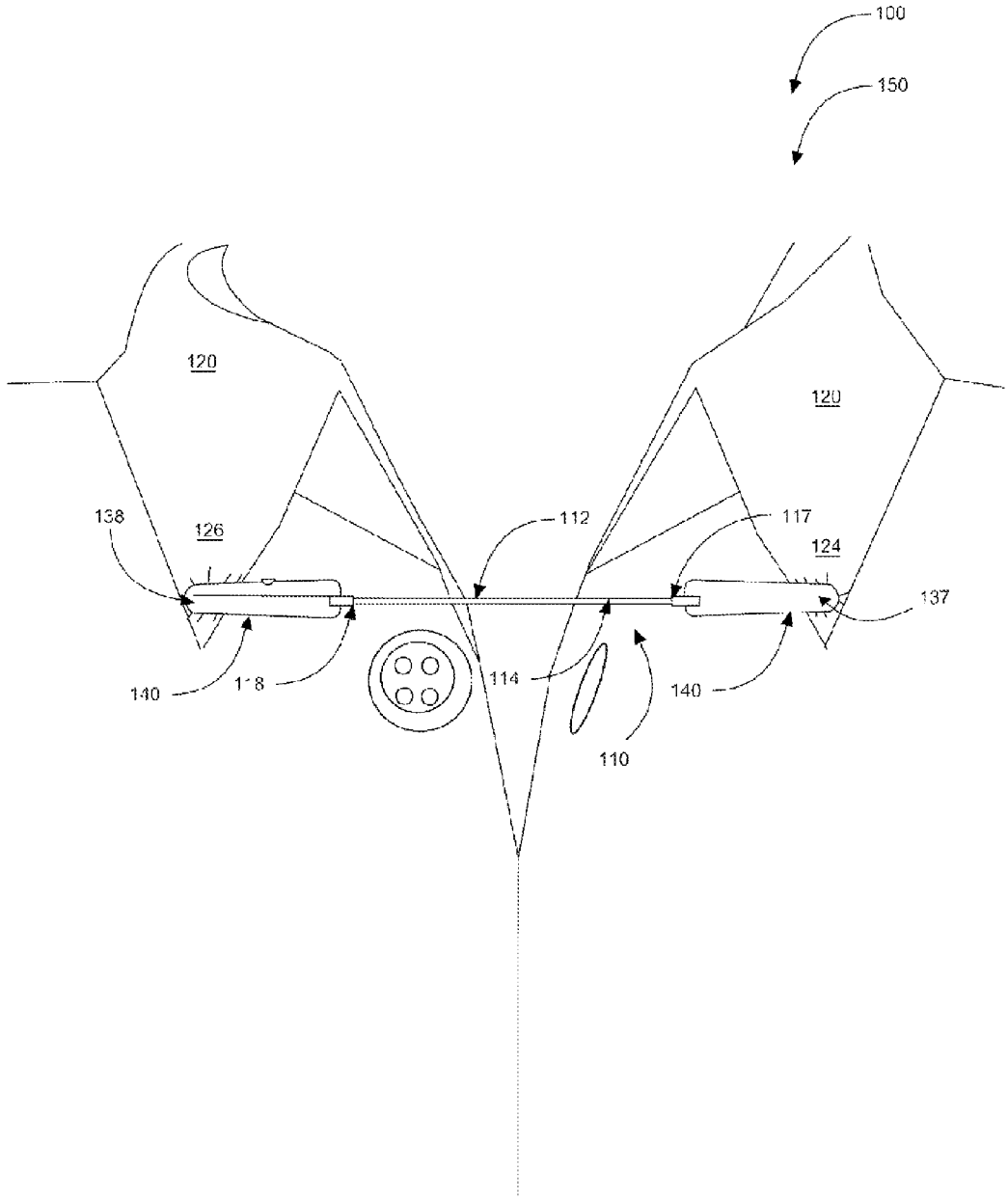
FIG. 1 shows a perspective view illustrating a decorative collar stay system in an in-use condition, according to an embodiment of the present invention.

Referring now to the drawings by numerals of reference there is shown in FIG. 1, a perspective view illustrating a decorative collar stay system 100 in an in-use condition 150, according to an embodiment of the present invention.

Decorative collar stay system 100 comprises a collar-stay-assembly 110 comprising a collar-link 112 having a first end 117 and a second end 118. The collar-link 112 is used to bridge a gap between the right side 124 and the left side 126 of a shirt-collar 120 to help the shirt-collar 120 stand up vertically. Certain embodiments are length adjustable via bending. The collar-link 112 is able to be adjustably-curved as desired by a user in certain embodiments.

Figure 2A:
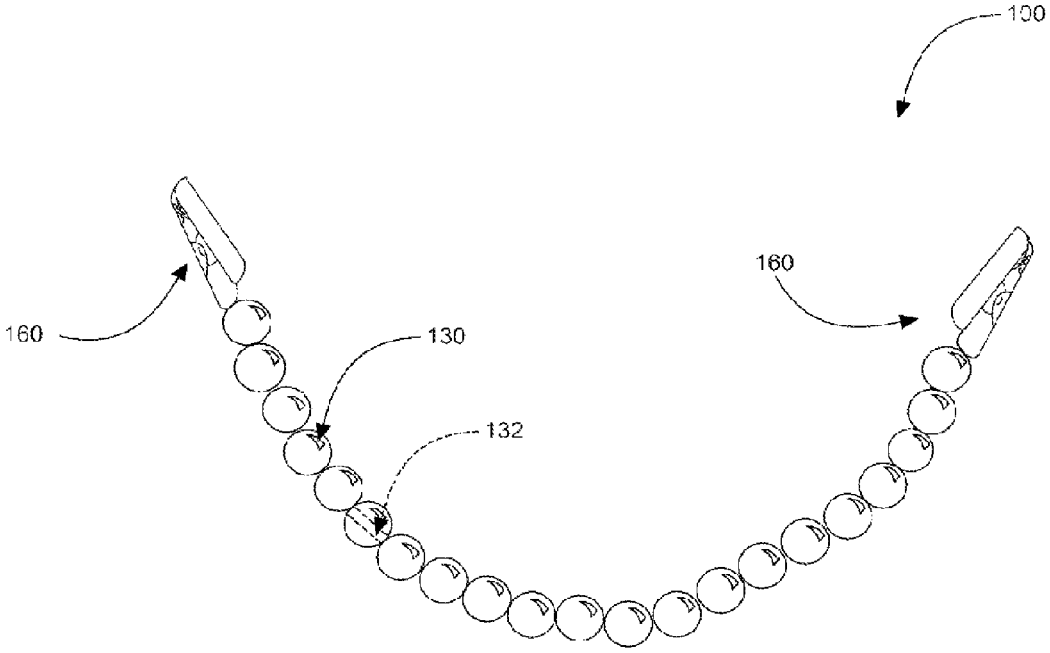
FIG. 2A is a perspective view illustrating a collar-stay-assembly adorned with decorative items according to an embodiment of the present invention of FIG. 1.

Referring now to FIG. 2A, a perspective view illustrating a collar-stay-assembly 110 adorned with decorative items 130 according to an embodiment of the present invention of FIG. 1.

The collar-link 112 may comprise a rod 114 that is cylindrical in preferred embodiments; however other shapes may be used in alternate embodiments. Rod 114 comprises an outer circumference 115 able to collectably-string a plurality of decorative items 130 thereon. The decorative items 130 comprise through-holes 132 to allow for 'stringing', and are selected from the group of stones consisting of natural turquoise, synthetic turquoise, natural rubies, synthetic rubies, natural emeralds, and synthetic emeralds, and from the group of jewelry consisting of beads, ivories, diamonds, pearls, woods, shells, and stones. Other stones or decorative items 130 may be used as per manufacturer/consumer preference.

The collar-link 112 is constructed from the group consisting of fiber optics, natural hair, synthetic hair, plastic, ceramic, leather, rope, silk, wire, chain, cloth, and chain in preferred embodiments. The collar-link 112 when comprising chain, for example, is able to be adjusted by removing and adding links. The length of the collar-link is adjustable in this way or others to bridge a gap between the right side 124 and the left side 126 of a shirt-collar 120 to help the shirt-collar 120 stand up vertically. The collar-link 112 is removably detachable from the right-side-attachment-clip 137 such that the decorative items 130 are able to be strung on the collar-link 112.

Figure 2B:
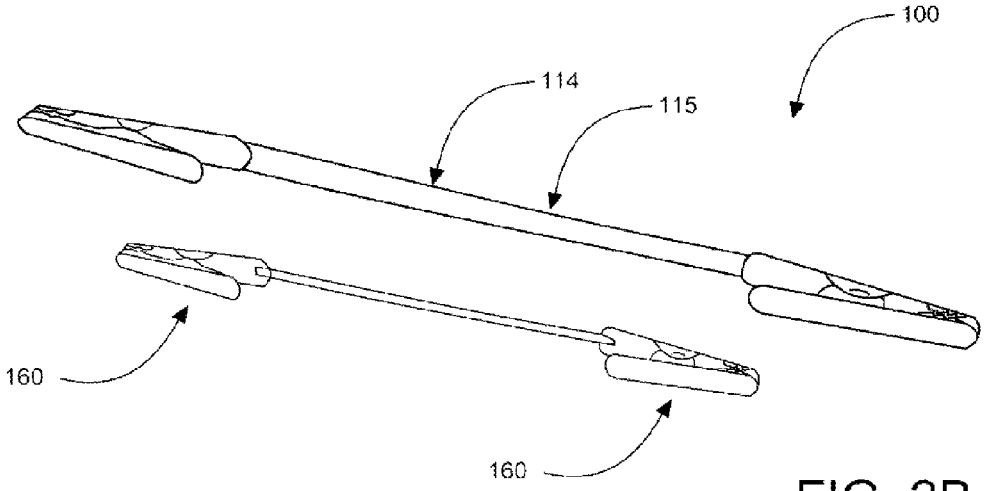
FIG. 2B is a perspective view illustrating collar-stay-assemblies not adorned with decorative items according to an embodiment of the present invention of FIG. 1.

Referring now to FIG. 2B, a perspective view illustrating collar-stay-assemblies not adorned with decorative items 130 according to an embodiment of the present invention of FIG. 1.

The pair of attachment-clips comprises a right-side-attachment-clip 137 and a left-side-attachment-clip 138 that in combination comprise a modular assembly. The first end 117 of the collar-link 112 is coupled to the right-side-attachment-clip 137 and the second end 118 of the collar-link 112 is coupled to the left-side-attachment-clip 138.

Figure 3:
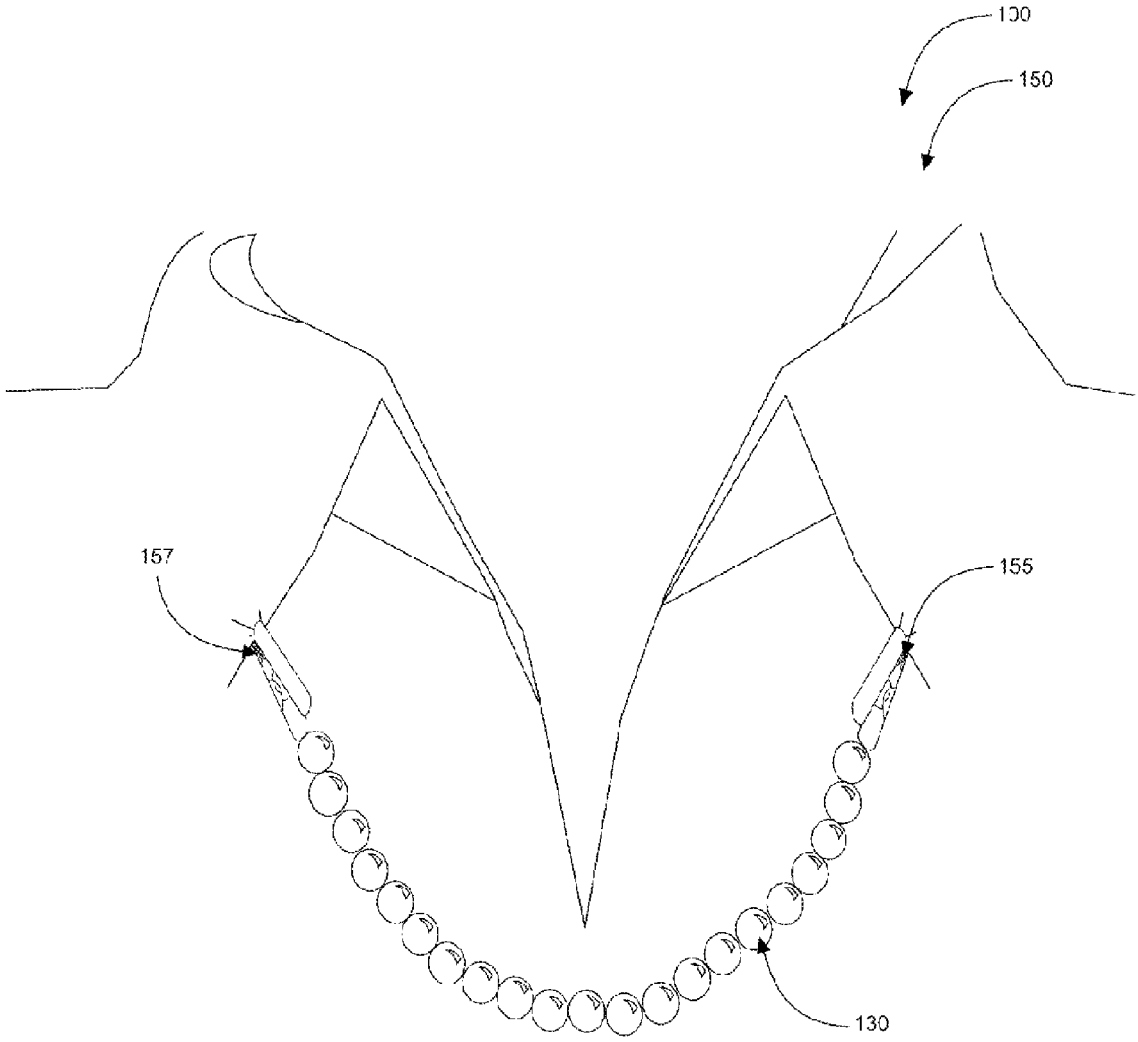
FIG. 3 is a perspective view illustrating the collar-stay-assembly in an in-use condition according to an embodiment of the present invention of FIG. 2A.

FIG. 3 is a perspective view illustrating the collar-stay-assembly 110 in an in-use condition 150 according to an embodiment of the present invention of FIG. 2A.

The decorative collar stay assembly 110 comprises, in combination, a collar-link 112 and the pair of attachment-clips. The right side 124 and the left side 126 of a shirt collar 120 are held in stasis via the collar-stay-assembly 110 while being worn by a user to provide a desired formal look. The collar-link 112 may be a rod 114 and is able to be adjustably-curved as desired by the user. The rod 114 of the collar-link 112 comprises an outer circumference 115 able to collectably-string a plurality of decorative items 130 thereon. The collar-link 112 is selected from the group of metals consisting of brass, copper, gold, silver, stainless-steel, tin, and titanium. Other materials may be used; however the mentioned metals are preferred.

Figure 4A:
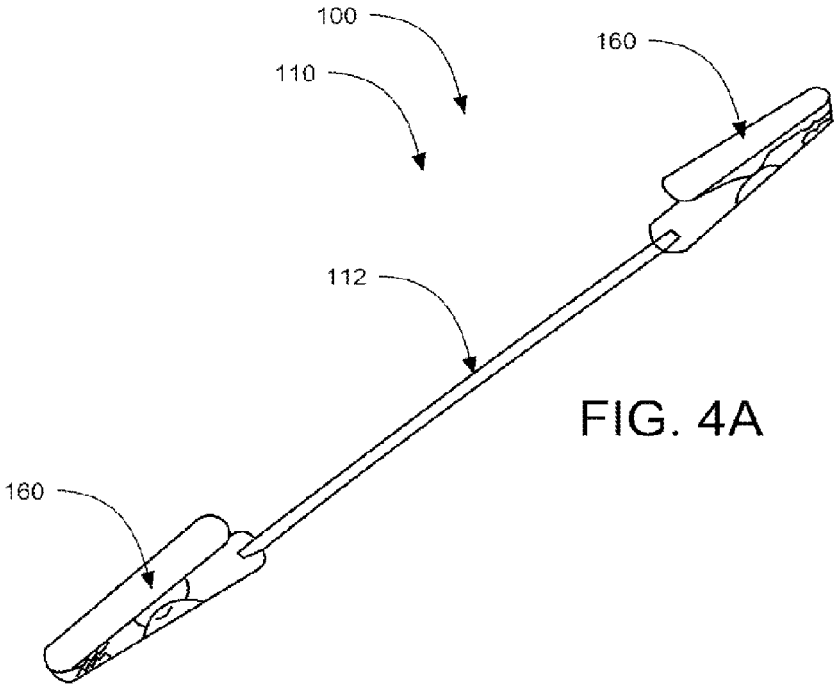
FIG. 4A is a perspective view illustrating the collar-stay-assembly according to an embodiment of the present invention of FIG. 1.

Referring now to FIG. 4A, a perspective view illustrating the collar-stay-assembly 110 according to an embodiment of the present invention of FIG. 1.

The pair of attachment-clips of the decorative collar stay system 110 may be alligator-type clips 140 and secured to the collar-link 112 by an attaching means selected from the group consisting of compressing, gluing, hooking, riveting, welding, soldering, vibration-welding, screwing, and sewing. Other suitable attaching means may be used; however welding is preferred due to its durability in non-removable embodiments. The pair of attachment-clips is preferably made of material selected from the group consisting of aluminum, brass, platinum, silver, stainless-steel, tin, and titanium. The pair of attachment-clips is made from material selected from the group consisting of ceramics, plastic, natural wood, and synthetic wood. The pair of attachment-clips may be adorned with decorative items 130 as shown in FIG. 3. The collar-link 112 and the right-side-attachment-clip 137 and the left-side-attachment-clip 138 comprise a modular assembly.

Figure 4B:
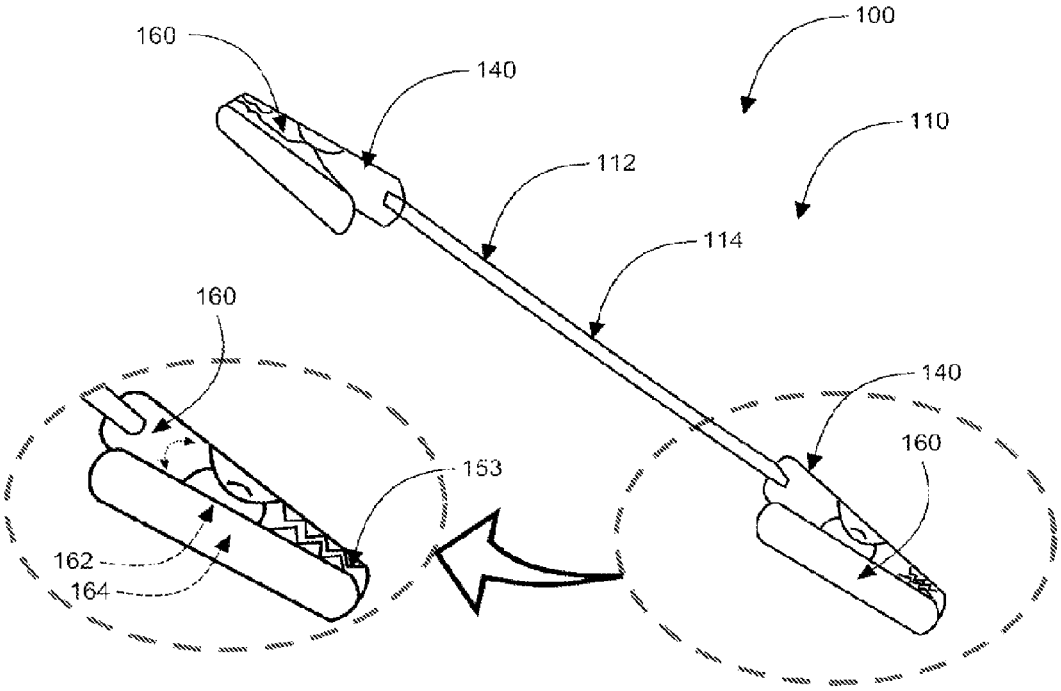
FIG. 4B is a perspective view illustrating the collar-stay-assembly with an exploded view of the biasing means of the alligator clip according to an embodiment of the present invention of FIG. 1.

Referring now to FIG. 4B, a perspective view illustrating the collar-stay-assembly 110 with an exploded view of the biasing means of the alligator clip(s) 140 according to an embodiment of the present invention of FIG. 1.

The collar-stay-assembly 110 further comprises exactly two attachment-clips comprising a right-side-attachment-clip 137 attached to the first end 117 of the collar-link 112 in preferred embodiments. The right-side-attachment-clip 137 is able to be biasingly-fastened and biasingly-unfastened to and from the right side 124 of a shirt collar 120, as shown and previously mentioned. The right-side-attachment-clip 137 may comprise an alligator-type clip 140 comprising a biasing-jaw 160, a tension-spring 162, a spring-release-mechanism 164. The collar-stay-assembly 110 may be removably adorned with decorative items 130. The right-side-attachment-clip 137 further comprises a plurality of first jaw-teeth 155 located inside the right-side-attachment-clip 137 to secure a shirt collar 120 therein.

The collar-stay-assembly 110 also comprises a left-side-attachment-clip 138 attached to the second end 118 of the collar-link 112. The left-side-attachment-clip 138 is able to be biasingly-fastened and biasingly-unfastened to and from the left side 126 of a shirt collar 120. The left-side-attachment-clip 138 comprises an alligator-type clip 140 which may comprise a biasing-jaw 160, a tension-spring 162, and a spring-release-mechanism 164. The left-side-attachment-clip 138 further comprises a plurality of second jaw-teeth 157 located inside the left-side-attachment-clip 138 to secure a shirt collar 120 therein via gripping fractioning means.

Decorative collar stay system 100 according to an embodiment of the present invention of FIGS. 1-4B, may be sold as kit 450 comprising the following parts: at least one collar-link 112; decorative items 130; at least one right-side-attachment-clip 137; at least one left-side-attachment-clip 138; and at least one set of user instructions. Decorative collar stay system 100 may be manufactured and provided for sale in a wide variety of sizes and shapes for a wide assortment of garmenting staying applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
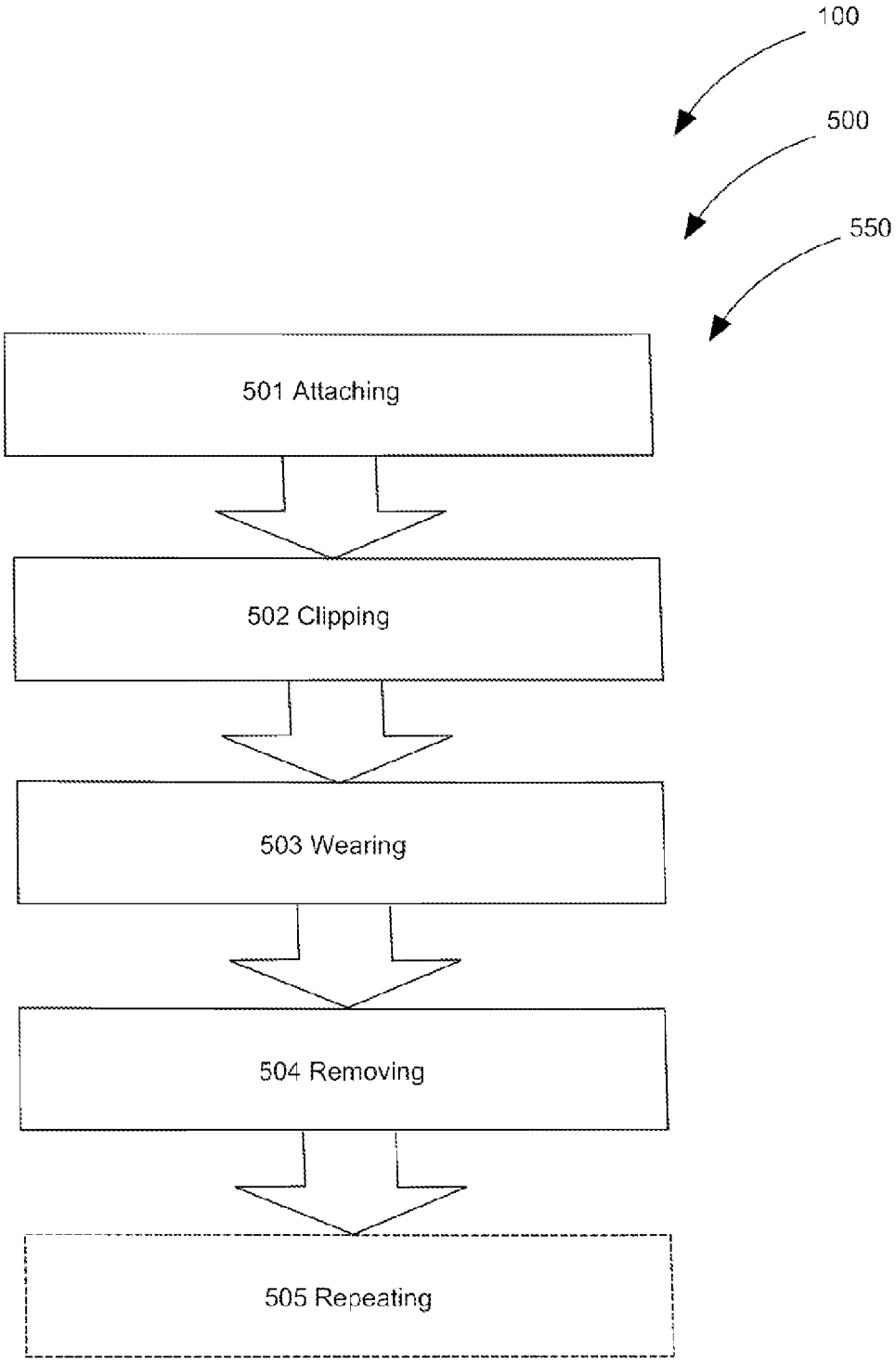
FIG. 5 is a flowchart illustrating a method of use of a decorative collar stay system according to an embodiment of the present invention of FIGS. 1-4B.

FIG. 5 is a flowchart 550 illustrating a method of use 500 of a decorative collar stay system 100 according to an embodiment of the present invention of FIGS. 1-4B. A method of use 100 for decorative collar stay system 100 may comprise the steps of: step one 501 attaching biasing-jaw(s) to collar-link to complete a collar-stay-assembly; step two 502 clipping collar-stay-assembly to right side of shirt collar and left side of shirt collar; step three 503 wearing collar-stay-assembly; step four 504 removing collar-stay-assembly prior to removing shirt; and step five 505 repeating the above mentioned steps as often as desired by user.

It should be noted that step five 505 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A decorative collar stay system comprising:

a) a collar-stay-assembly including;

i) a collar-link having a first end and a second end; and ii) a pair of attachment-clips comprising;

(1) a right-side-attachment-clip attached to said first end of said collar-link, said right-side-attachment-clip is structured and arranged to be biasingly-fastened and biasingly-unfastened to and from a right side of a shirt collar;

(2) a plurality of first jaw-teeth located inside said right-side-attachment-clip to secure said shirt collar therein;

(3) a left-side-attachment-clip attached to said second end of said collar-link, said left-side-attachment-clip is structured and arranged to be biasingly-fastened and biasingly-unfastened to and from a left side of said shirt collar; and (4) a plurality of second jaw-teeth located inside said left-side-attachment-clip to secure said shirt collar therein;

b) wherein said pair of attachment-clips comprise said right-side-attachment-clip and said left-side-attachment-clip;

c) wherein said first end of said collar-link is coupled to said right-side-attachment-clip and said second end of said collar-link is coupled to said left-side-attachment-clip;

e) wherein said collar-stay-assembly is structured and arranged for holding in stasis said collar-stay-assembly relative to said right side of said shirt collar and said left side of said shirt collar while being worn by a user to provide a desired formal look.

2. The decorative collar stay system of claim 1 wherein said collar-link is structured and arranged to be adjustably-curved as desired by said user.

3. The decorative collar stay system of claim 2 wherein said collar-link is a rod.

4. The decorative collar stay system of claim 3 wherein said collar-link is selected from the group of metals consisting of brass, copper, gold, silver, stainless-steel, tin, and titanium.

5. The decorative collar stay system of claim 3 wherein said rod comprises an outer circumference structured and arranged to selectively receive a plurality of decorative items thereon.

6. The decorative collar stay system of claim 5 wherein said decorative items are selected from the group of jewelry consisting of beads, ivories, diamonds, pearls, wooden elements, shells, and stones.

7. The decorative collar stay system of claim 6 wherein said collar-link is selected from the group consisting of fiber optics, natural hair, synthetic hair, plastic, ceramic, leather, rope, silk, wire, chain, and cloth.

8. The decorative collar stay system of claim 7 wherein said collar-link is of a length adjustable structured and arranged to bridge a gap between said right side and said left side of said shirt-collar to help said shirt-collar stand up vertically.

9. The decorative collar stay system of claim 8 wherein said collar-link when comprising said chain is structured and arranged for adjusting by removing and adding links.

10. The decorative collar stay system of claim 1 wherein said attachment-clips are secured to said collar-link by an attaching means selected from the group consisting of compressing, gluing, hooking, riveting, welding, soldering, vibration-welding, screwing, and sewing.

11. The decorative collar stay system of claim 10 wherein said pair of attachment-clips are alligator-type clips.

12. The decorative collar stay system of claim 11 wherein said pair of attachment-clips are made of material selected from the group consisting of aluminum, brass, platinum, silver, stainless-steel, tin, and titanium.

13. The decorative collar stay system of claim 6 wherein said attachment-clips are adorned with said decorative items.

14. The decorative collar stay system of claim 1 wherein said pair of attachment-clips are made from material selected from the group consisting of ceramics, plastic, natural wood, and synthetic wood.

15. The decorative collar stay system of claim 1 wherein said collar-link and said right-side-attachment-clip and said left-side-attachment-clip are a modular assembly.

16. The decorative collar stay system of claim 5 wherein said decorative items comprise through-holes to allow for stringing.

17. The decorative collar stay system of claim 5 wherein said decorative items are selected from the group of stones consisting of natural turquoise, synthetic turquoise, natural rubies, synthetic rubies, natural emeralds, and synthetic emeralds.

18. The decorative collar stay system of claim 5 wherein said collar-link is removably detachable from said right-side-attachment-clip such that said decorative items are structured and arranged for stringing on said collar-link.

19. A decorative collar stay system comprising:

a) a collar-stay-assembly including;

i) a collar-link having a first end and a second end;

ii) said collar-link is used to bridge a gap between a right side and a left side of a shirt-collar to help said shirt-collar stand up vertically;

iii) said collar-link is structured and arranged to be adjustably-curved as desired by a user;

iv) and v) said collar-link comprising a rod that is cylindrical, said rod comprising an outer circumference structured and arranged to collectably-string a plurality of decorative items thereon, said decorative items comprising through-holes to allow for stringing;

b) exactly two attachment-clips comprising;

i) a right-side-attachment-clip attached to said first end of said collar-link, said right-side-attachment-clip is structured and arranged to be biasingly-fastened and biasingly-unfastened to and from said right side of said shirt collar;

ii) said pair of attachment-clips comprising alligator-type clips;

iii) said attachment-clips are adorned with said decorative items;

iv) a plurality of first jaw-teeth located inside said right-side-attachment-clip to secure said shirt collar therein;

v) a left-side-attachment-clip attached to said second end of said collar-link, said left-side-attachment-clip is structured and arranged to be biasingly-fastened and biasingly-unfastened to and from said left side of said shirt collar; and vi) a plurality of second jaw-teeth located inside said left-side-attachment-clip to secure said shirt collar therein;

c) wherein said collar-link and said right-side-attachment-clip and said left-side-attachmentd) clip comprise a modular assembly;

e) wherein said pair of attachment-clips comprise said right-side-attachment-clip and f) said left-side-attachment-clip;

g) wherein said first end of said collar-link is coupled to said right-side-attachment-clip h) and said second end of said collar-link is coupled to said left-side-attachment-clip;

i) wherein said collar-link is removably detachable from said right-side-attachment-clip j) such that said decorative items are structured and arranged to be strung on said collar-link;

k) wherein said decorative collar stay assembly comprises in combination said collar-link and said attachment-clips; and l) wherein said right side and said left side of said shirt collar are held in stasis via said collar-stay-assembly while being worn by a user to provide a desired formal look.

20. A kit for a decorative collar stay system of claim 19 having:

a) two attachment-clips;

b) a collar-link;

c) decorative items; and d) wherein a right side and a left side of a shirt collar are held in stasis via a collar-stay-assembly comprising said two attachment-clips, said collar-link, in combination, while being worn by a user to provide a desired formal look.

* * * * *